United States Patent [19]

Leatherman

[11] 4,238,862

[45] Dec. 16, 1980

[54] POCKET MULTIPLE TOOL

[76] Inventor: Timothy S. Leatherman, 2010 NE. 91st Ave., Portland, Oreg. 97220

[21] Appl. No.: 924,180

[22] Filed: Jul. 13, 1978

[51] Int. Cl.[3] ..... B25B 7/22

[52] U.S. Cl. ..... 7/128; 81/424; 81/428 R

[58] Field of Search ..... 7/106, 118, 125, 127–131; 81/303–305, 307, 422, 424, 428 R; 30/255

[56] References Cited

U.S. PATENT DOCUMENTS

| | | | |
|---|---|---|---|
| 858,003 | 6/1907 | Klever | 30/255 X |
| 1,174,132 | 3/1916 | Dragun . | |
| 1,187,842 | 6/1916 | Kaas . | |
| 1,334,425 | 3/1920 | Wernimont . | |
| 1,467,661 | 9/1923 | Undy | 7/125 X |
| 1,474,592 | 11/1923 | Jacoby . | |
| 1,551,328 | 8/1925 | Perry . | |
| 1,561,833 | 11/1925 | Cruickshank . | |
| 1,619,181 | 3/1927 | Beretz . | |
| 2,514,130 | 7/1950 | Jones . | |
| 2,561,682 | 7/1951 | Barnett . | |
| 2,575,652 | 11/1951 | Bovee | 7/128 X |
| 2,641,149 | 6/1953 | Petersen . | |
| 2,747,446 | 5/1956 | Eder . | |
| 3,044,081 | 7/1962 | Robinson, Jr. . | |

FOREIGN PATENT DOCUMENTS

| | | |
|---|---|---|
| 5375 | of 1882 | United Kingdom . |
| 21369 | of 1894 | United Kingdom . |
| 15859 | of 1904 | United Kingdom . |

*Primary Examiner*—James G. Smith
*Attorney, Agent, or Firm*—Lee R. Schermerhorn

[57] ABSTRACT

Channel shaped handles are foldable over plier jaws for compact carrying and storage. Auxiliary parallel jaws are operable by the main jaws when desired. Locking means are provided, operable with both sets of jaws to maintain a strong grip on an object when the handles are released. The handles also contain other tools, some of which may be opened out to provide handle extensions for increasing the leverage on the pliers.

23 Claims, 17 Drawing Figures

POCKET MULTIPLE TOOL

BACKGROUND OF THE INVENTION

This invention relates to improvements in a folding pocket multiple tool having pliers and other frequently needed tools incorporated into a single instrument.

Certain tools are often needed in situations where it is impractical or at least inconvenient to go prepared with a well equipped tool box. For example, hunters, fishermen, campers, bicyclists and even motorcyclists and automobilists have frequent need for a variety of common tools which are not available when the need arises. Even in the home workshop or portable tool box it is often convenient to provide a single multiple tool that will take the place of a considerable number or separate tools.

A review of U.S. Pat. Nos. 1,474,592; 2,747,446; 1,174,132; 1,334,425; 3,044,081; 1,187,842; 2,561,682; 1,619,181; 858,003 and British Pat. Nos. 5,375 (1882); 21,369 (1894) and 15,859 (1904) shows that devices herefore proposed for such purposes have not been as satisfactory in regard to the performance and effectiveness of the individual tools as the present invention, nor have they included as many useful tools in as compact and novel an arrangement.

Objects of the present invention are therefore to provide an improved multiple tool, to provide a multiple tool having both cross-jaw pliers and parallel-jaw pliers, to provide an instrument in which certain of the auxiliary tools are arranged to serve as handle extensions for increasing the leverage on the pliers, to provide novel and improved locking means for the pliers and to provide a pocket tool of the type described which is convenient to store and efficient in operation.

SUMMARY OF THE INVENTION

In the present construction a pair of channel shaped handles are foldable over plier jaws for compact carrying and storage. Auxilary parallel jaws are operable by the main jaws when desired. Locking means operable on both sets of jaws are provided to maintain a strong grip on an object when the handles are released. The handles also contain various other tools, some of which may be opened out to provide handle extensions for increasing the leverage on the pliers.

In the preferred embodiments illustrated, the two pairs of plier jaws are mounted on one end of the handles while the other tools are arranged to pivot out to operative positions at the opposite ends of the handle members.

The invention will be better understood and the foregoing and additional objects and advantages will be apparent from the following detailed description of the preferred embodiments illustrated in the accompanying drawings. Various changes may be made, however, in the details of construction and arrangement, substitution or addition of parts; and certain features may be used without others. All such modifications within the scope of the appended claims are included in the invention.

DESCRIPTION OF THE PREFERRED EMBODIMENT

Figure 1:
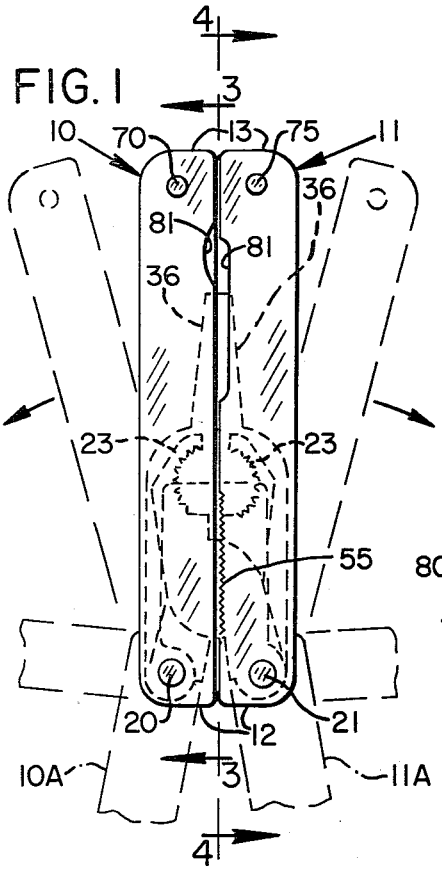
FIG. 1 is a side elevation view of a tool embodying the invention, the handles being shown in folded position in solid lines, the broken line positions of the handles illustrating how the handles are opened out to operative positions.

In the present instrument a plurality of tools are contained within a pair of handles 10 and 11 when the handles are folded together in closed position as shown in solid lines in FIG. 1. Each handle has a connected end 12 and a free end 13. Access to the various tools is obtained by spreading apart the free ends 13 of the handles as indicated by the arrows and the positions of the handles shown in broken lines as they are rotated away from each other toward the open positions indicated at 10A and 11A. In this opening movement each handle is rotated almost 180°.

Figure 2:
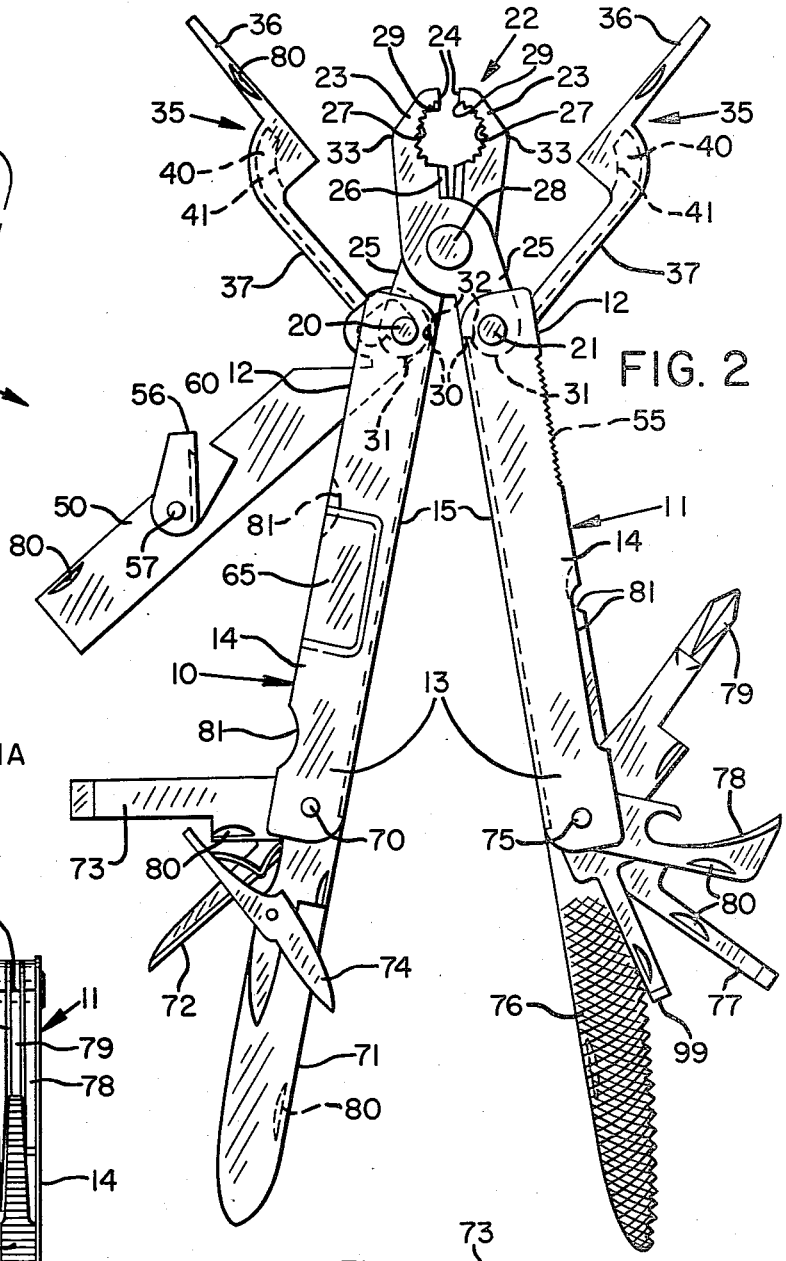
FIG. 2 is a side elevation view showing the various parts opened out for illustrative purposes.

The handle positions at 10A and 11A in FIG. 1 correspond with the handle positions shown in FIG. 2. Each handle 10 and 11 is of channel shape having a pair of side flanges 14 bent up on opposite edges of web portions 15. When the handles are folded together as shown in solid lines in FIG. 1 the two channels face each other and enclose all of the tools contained in the instrument, for storage. When the handles are opened to their FIG. 2 positions, the two channels face outward away from each other, making all the tools accessible, as shown. In this position the web portions 15 of the two channels are facing each other.

Transverse pivot pins 20 and 21 are mounted in the side flanges 14 at the connected ends 12 of the two channels. Cross-jaw pliers 22 are connected to the pivot pins 20 and 21. Each of these plier jaws has a nose end 23 with a flat gripping surface 24 intended primarily for gripping thin flat objects, and a shank end 25. Each shank end 25 is apertured for pivotal mounting on its associated pivot pin 20 or 21. The plier jaws are also equipped with wire cutter blades 26 and serrated concave gripping portions 27 shaped to grip securely round, square and hex-shaped objects. The two jaws are pivotally connected together by pivot 28 solely for rotation about the longitudinal axis of this pivot.

When squeezing forces are applied to the handles 10 and 11, the end of web portions 15 of the handle channels bear against radial abutements 30 on the shanks 25 to apply the squeezing forces to the nose ends 23 of the plier jaws. The handles are slightly divergent when bearing against the radial abutements 30 so that the operator may readily grip the handles to open the jaws.

In order to provide positive opening of the plier jaws the handles 10 and 11 are frictionally locked to the respective jaws. For this purpose the shank end 25 of each jaw has a cam surface 31 which is resiliently engaged by the inside surface of the extremity of web portion 15. Flat portions 32 on each cam surface 31 adjacent the abutements 30 enhance this frictional lock between the handles and the jaw shanks so that when the handles are pulled apart the nose ends of the jaws will be separated even though they may tend to stick to the objects being gripped or to resist opening due to frictional forces introduced during assembly of cross jaws 22 with pivot pin 28. Thus without any cuts or slots to weaken the web 15 or sides 14 of the connected ends 12 of the channel shaped handles 10 and 11, except of course, for pins 20 and 21, it is possible to transmit powerful gripping or cutting forces to the operative portions of the jaws.

The frictional engagement of channel web portions 15 with cam surfaces 98 on the shank end 25 of each jaw (FIGS. 7 and 8) operates to hold the handles together in closed position as shown in FIG. 1 so that the handles will not open when the instrument is jostled in the pocket or tool box.

The instrument is also equipped with a pair of parallel jaw pliers jaws 35 each having a nose and 36 and a shank end 37. The nose ends may be of needle nose shape as shown or any other desired shape within the obvious constraints imposed by other parts of the instrument. The shank ends 37 are of channel shape to close over and slidingly receive the jaws of the cross-jaw pliers 22. Each parallel jaw nose end 36 contains a cavity or pocket 40 to receive the nose end 23 of a jaw of the cross-jaw pliers 22, the bases of the pockets 40 having cam surfaces 41 which are slidably engaged by the gripping edges 29 of the cross-jaws pliers. The close fit between the insides of the cavities 40 and the outsides of nose ends 23 of the cross jaw pliers prevents lateral motion of the parallel jaws 35.

Figures 7, 8, 9, 10, 11, 12, 13, 14:
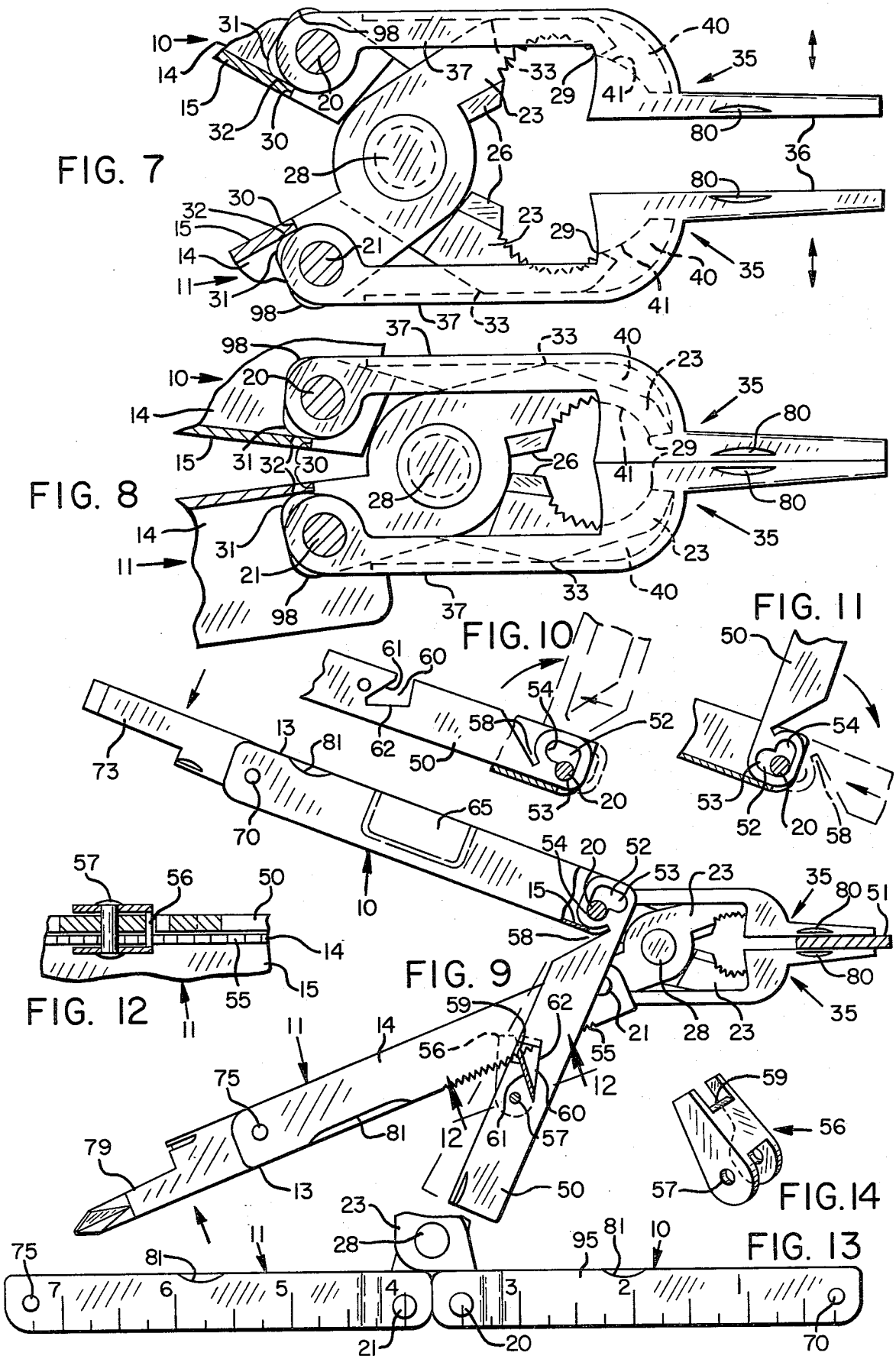
FIG. 7 is an enlarged fragmentary side elevation view, with parts in section, showing a first step in the manipulation of the parallel jaw pliers.
FIG. 8 is a view similar to FIG. 7 showing the parallel jaw pliers in closed position.
FIG. 9 is a side elevation view with parts broken away showing the operation of the locking bar.
FIGS. 10 and 11 are fragmentary views of certain parts in FIG. 9 showing the manipulation for opening of the locking bar.
FIG. 12 is a view on the line 12—12 in FIG. 9.
FIG. 13 is a fragmentary side elevation view showing the use of the measuring scale.
FIG. 14 is a perspective view of the tooth engagement pawl.

Shank ends 37 are pivotally mounted on pivot pins 20 and 21 between the shanks 25 of the pliers and the sides 14 of the handles. The webs of the shank ends 37 of the parallel jaws are cut out an appropriate distance from the pins 20 and 21 so that for convenience and greater utility the parallel jaws may be rotated independently of the cross jaws 22 completely into the handles 10 and 11 for storage while the operator is using the cross jaw pliers When the cross-jaw pliers 22 in FIG. 2 are opened wide, the parallel jaws 35 may be swung over the ends of the jaw noses 23. This relationship is shown in FIG. 7 where the cross-jaw noses 23 are starting to enter the pockets 40. The relationship of the parts is such that the parallel jaw nose ends 36 are parallel with each other in this position. Then as the cross-jaw noses 23 are closed together, the gripping edges 29 slide along cam surfaces 41 and cam the parallel jaws together as shown in FIG. 8.

The shape of cam surfaces 41 is such that the parallel relationship of noses 36 is maintained during the movement from the FIG. 7 position to the FIG. 8 position wherein the noses 23 have reached the forward ends of pockets 40. To retain parallelism of the jaws 35, the cam surface 41 curvature is necessary because for greater utility of this instrument, the distances between the centerlines of pins 20 (and 21) and 28 and the centerline of pin 28 and nose gripping edge 29 are different. Applying the geometric and trigonometric relationship between the parts at various jaw openings determines the shape of cam surface 41.

The shape of the outer nose surfaces 33 of the cross-jaw noses 23 is such that as the cross-jaw gripping edges 29 slide along the cam surfaces 41 of the parallel jaw cavities 40, the outer nose surfaces 33 of cross-jaw noses 23 are gliding very near the interior surfaces of the webs of the parallel jaw shanks 37. Thus, with a slight reversal of the motion of the handles 10 and 11, the motion of the parallel jaws is reversed, causing the parallel jaws 35 to open with outer nose surfaces 33 of the cross-jaw noses 23 pushing against the interior of the webbed members of parallel jaws shanks 37.

Figure 15:
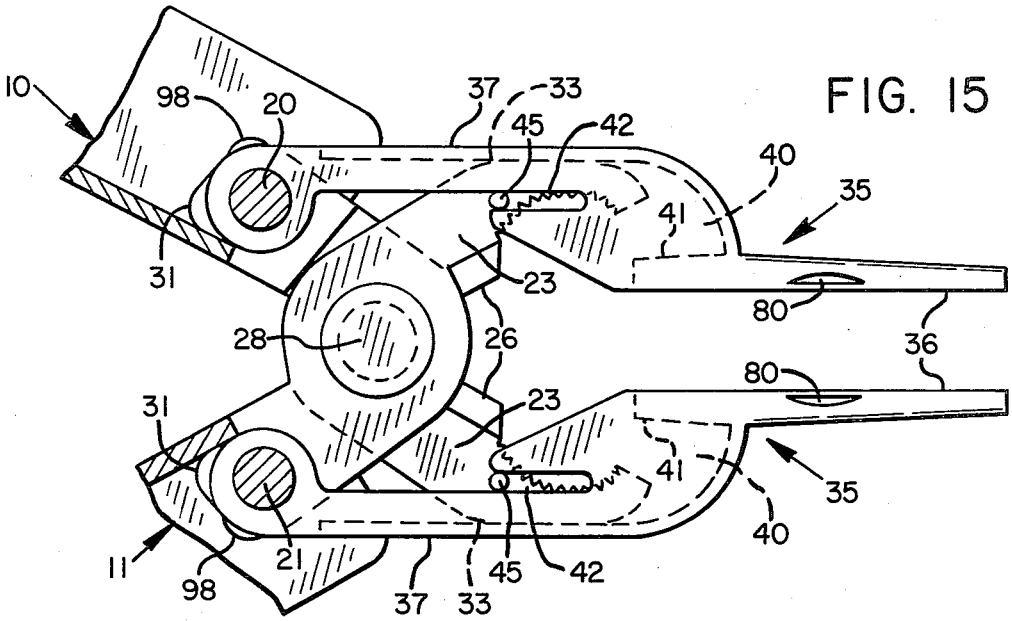
FIGS. 15 and 16 are enlarged fragmentary side elevation views, with parts in section, showing an alternative arrangement of the parallel jaws.
Figure 16:
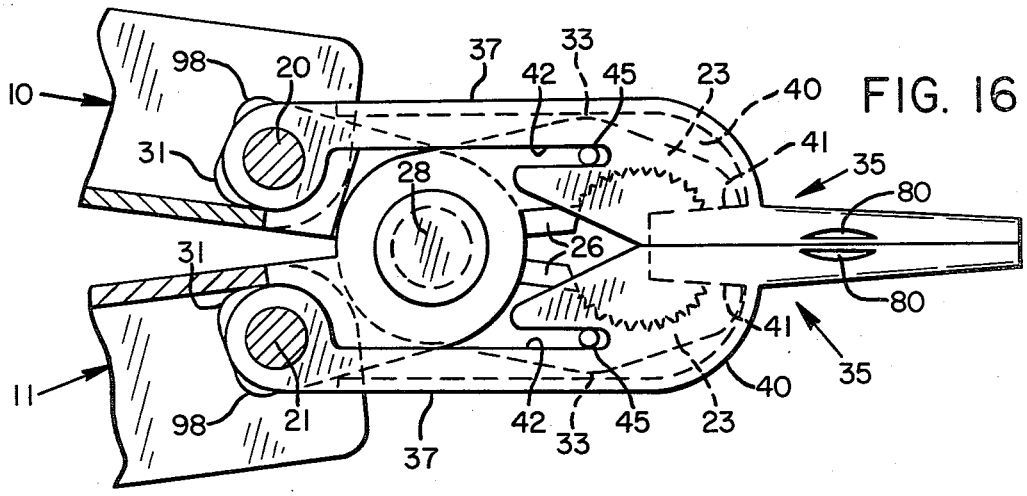

FIGS. 15 and 16 show an alternative method of obtaining parallel movement of the parallel jaws 35. A boss or pin 45 on or through cross-jaw noses 23 is located such that centerline distances 20 (and 21)–28 and 28–45 are equal and such that imaginary lines through 20 (and 21)–28 and 28–45 form equal acute angles with the longitudinal axis. The boss 45 engages a horizontal slot or groove 42 in the sides of the channel shaped shank 37 of the parallel jaw. Forces applied to handles 10 and 11 to open and close the cross-jaws 22 are transferred through the boss 45 to the edges of the slot 42 to open and close the parallel jaws.

The shapes of cross-jaw surfaces 33 and cavity surfaces 41 are not important to the parallelism so long as the cross-jaw noses 23 can freely enter and leave the parallel jaw cavities 40. When the cross jaws 23 are fully open, the boss 45 is disengaged from the slot 42 and parallel jaws 35 can be rotated into storage independently of cross-jaws 23. The boss 45 could be located elsewhere than described above, but the shape of the slot to retain parallelism would be different. The boss or pin and slot can be on one or both sides of the cross-jaws and parallel jaws.

Although the preferred embodiments of part of this invention are described above, the scope of this invention applies to any instrument with a pair of pivoted crossed members having pivotally attached a pair of non-crossed auxiliary jaws with cavities that are engaged by the crossed members to cause opening and closing of the auxiliary jaws; and, when the pair of pivoted crossed members are opened wide, completely disengage from the cavities of the pair of auxiliary jaws. This feature of the invention is not limited to use in a folding pocket tool having hollow handles into which the plier jaws may be folded for compact storage.

FIGS. 2 and 9–12 illustrate the manipulation of the locking bar 50 to lock the jaws in gripping position when an object is gripped by either the cross-jaw pliers 22 or the parallel jaws 35. By way of example, FIG. 9 shows an object 51 clamped between the parallel jaws 35. One end of locking bar 50 has an L-shaped slot 52 receiving pivot pin 20 to mount the locking bar in handle 10. Slot 52 has one end 53 directed perpendicular to the length of bar 50 and an opposite end 54 directed lengthwise of the bar.

In storage position within handle 10 pivot pin 20 is disposed in the end 53 of slot 52 as shown in FIG. 10. For convenience of explanation FIG. 10 is co-ordinated with FIG. 9 whereby the solid line position of bar 50 in FIG. 10 assumes the same angle on the drawing as handle 10 in FIG. 9, representing the storage position of bar 50 in handle 10.

To use locking bar 50, it is first opened out of handle 10 to approximately a 90° angle as shown in broken lines in FIG. 10. Then the locking bar 50 is shifted to place pivot pin 20 in the center of slot 52 as shown in solid lines in FIG. 11. Then the locking bar may be rotated 90° farther in clockwise direction as shown in broken lines in FIG. 11. Finally, the locking bar is shifted to place pivot pin 20 in end 54 of the slot 52 allowing the locking bar to be rotated clockwise into notch 58 around the end of the web 15 of the connecting end 12 of handle 10 to one of its operative positions shown in FIG. 9.

The location of the pin 20 relative to the height of handle 10 and the length of web 15 toward the connecting end 12 of handle 10 and the amount of rotation of the locking bar required for locking in all jaw opening positions dictate the distance required between positions 53 and 54 and the amount of material remaining in locking bar 50 opposite notch 58. Handle 10 is wider than handle 11 and has spacer 18 on pin 20 in FIG. 3, allowing the locking bar to extend along side handle 11 as shown in FIG. 9.

The side flange 14 on handle 11 adjacent the locking bar 50 in FIG. 9 is provided with fine teeth 55 along its outer edge. There are enough teeth that locking is possible on a gripped object at any jaw opening. These teeth are engaged by tooth engagement edge 59 of pawl 56. The pawl 56 has pivotal movement on a pin 57 in a substantially V-shaped notch 60 in locking bar 50 and lateral movement along pin 57 within the constraints of the insides of the channels of the pawl against the outside of the locking bar.

Figure 3:
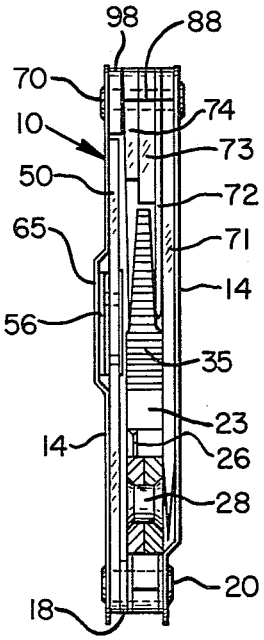
FIG. 3 is a view on the line 3—3 in FIG. 1.

The pawl is moved to one side during storage as shown in FIG. 3 and for opening of the locking bar, and to the other side for engagement with the teeth 55 as shown in FIG. 12. The sides of the channel shaped pawl keep the locking bar 50 and the toothed side 14 of handle 11 together during locking as shown in FIG. 12. One side 61 of the notch 60 provides a stop for positioning the pawl near the correct tooth for locking the jaws and prevents the operator from attempting to engage a tooth in which a subsequent attempt to lock the jaws would break a part of the instrument.

FIG. 9 shows the locking bar 50 in solid outline and the web of the pawl 56 in cross section with the tooth engagement edge 59 engaged in a tooth 55 ready to lock the gripped object 51. During locking, the surfaces of locking bar notch 58 adjacent to slot end 54 pulls against the inside surface of web 15 of handle 10 which in turn transmits the forces through pin 20 to one of the pliers jaws. 23. The equal and opposite force obtained from the equilibrium position of locking is transmitted to the other jaw 23 from locking bar 50 through pin 57 to pawl tooth engagement edge 59 to handle 11 to pin 21.

Equilibrium (locking), shown in broken lines in FIG. 9, is obtained when by squeezing locking bar 50 and handle 11 the pawl tooth engagement edge 59 engaged in a tooth 55 rotates in toggle link action just past an imaginary line between the vicinity of pin 20 and pin 57 and rests against stop 62. The multiplication of jaw gripping forces over applied locking forces occurs through the arrangement of the parts generally as shown and through the reduction of length between initial engagement distance 20–59 and locked distances 20–59 because of the rotation of locking bar 50 and pawl 56. Gripping forces obtained at the jaws 23 are independent of any squeezing forces applied between handles 10 and 11 although handles 10 and 11 may be squeezed together to hold a gripped object in place while locking.

Unlocking and storage of the locking parts is the reverse of the procedure described above. A slight bulge 65 in side flange 14 of the handle 10 and a spacer 18 between shank 37 and locking bar 50 on pivot pin 20 are provided to accommodate the thickness of pawl 56 and length of pin 57 as shown in FIG. 3.

Locking bar slot 52 is L-shaped because an L-shape best prevents binding of the locking bar at any jaw opening position. Without the proper slot orientation and the resulting restraints of the surface of the slot acting against pin 20 with proper orientation, it is possible that, during locking, the part of the locking bar contacting the web 15 of handle 10 will slip and pin 20 will slide down slot 52 before locking is achieved. The locking bar would then be bound and unlocking would be extremely difficult.

Figure 17:
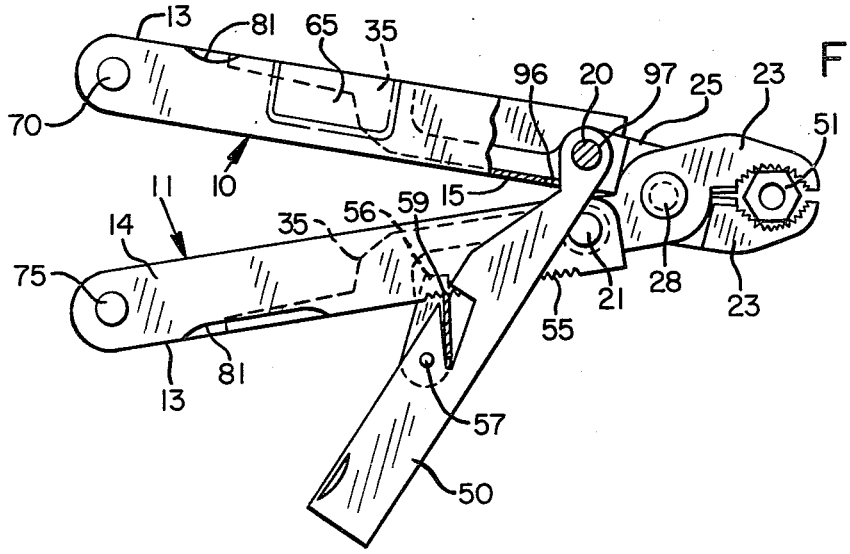
FIG. 17 is a side elevation view with parts broken away showing the operation of an alternative construction of the locking bar.

FIG. 17 shows an alternative method of constructing the locking bar 50 without the slot 52. The construction and operation are substantially the same as described above except that a circular hole 97 in locking bar 50 receives pin 20 and locking bar 50 pulls directly on pin 20 during locking instead of on web 15 of handle 10. A slot 96 long enough and the width of the locking bar under the locking bar in the connecting end 12 of the web 15 of handle 10 allows the locking bar to rotate enough to engage any tooth 55 necessary for locking any sized object 51 within the gripping range of the jaws.

Locking bar 50 need not be attached to pivot pin 20. It could be attached, with obvious modifications, to another pivot located anywhere along handle 10 or the shank of the crossed jaw 25 to which handle 10 is attached.

For locking of crossed jaws 23 to occur, the distance between pivot 20 and pivot 57 must be greater than the distance between pivot 20 and tooth engagement edge 59.

Although the preferred embodiment of the locking means is shown and described above, the scope of this invention applies to any instrument with pivoted crossed members, or pivoted crossed members having pivotally attached one or more pairs of auxiliary jaws, in which a locking bar with attached pivoted pawl and means for stopping rotation of the pawl at a position suitable for locking, is pivoted about the shank of one crossed member and with an abutment means located on the shank or handle of the other crossed member suitable for engagement by the pawl at any jaw opening and may be manipulated to lock any pair of the jaws on each other or an object or objects gripped between them.

As shown in FIG. 2, a pivot pin 70 mounted in side flanges 14 at the free end 13 of handle 10 provides pivotal mounting means for other tools such as a knife blade 71, an awl 72, a large screwdriver bit 73, scissors 74, and spacer 98 (FIG. 3). The spacer 98 may be made of grindstone material suitable for sharpening fish hooks.

Similarly, in the other handle 11 a pivot pin 75 mounts a saw/file blade 76, a small screwdriver bit 77, a medium screwdriver bit 99, a can and bottle opener 78, and a Phillips screwdriver bit 79 permanently magnetized to hold a screw thereon. These tools may be used with the handles independently disposed in any of the various positions suggested by FIG. 1. Each tool as well as the parallel jaw nose ends 36 is provided with a fingernail grip 80 for opening the tool or jaw out of its handle and provision is made for accessability of these fingernail grips. In the handles 10 and 11 the side flanges 14 are cut away at 81 for this purpose.

Figure 5:
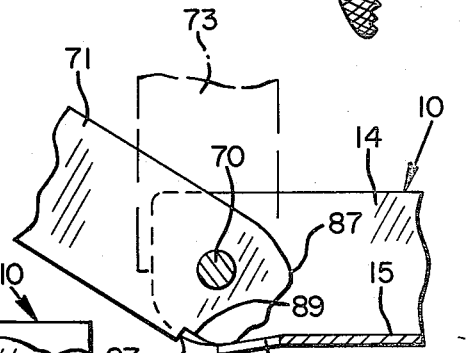
FIG. 5 is a fragmentary sectional view showing one of the auxilary tools in partially open position.

FIG. 5 shows a method of holding the tools just described in an open or partially open position. A pair of longitudinal slots 85 separates the extremity of web portion 15 from the side flanges 14 of the handle to provide a resilient spring tongue 86 which bears against cam surface 87 on the inner end of each tool. When the tool is pivoted about 180° out of the handle a radial stop 88 on the tool engages the end of tongue 86 to limit the pivoting movement of the tool on pivot pin 70. In order to hold the tool in such position the cam surface 87 is flattened at 89 adjacent the abutement 88. The cam surface may also be raised and flattened at one or more other positions in order that the spring 86 will better hold a tool in a partially open position, as indicated at 73.

Figure 6:
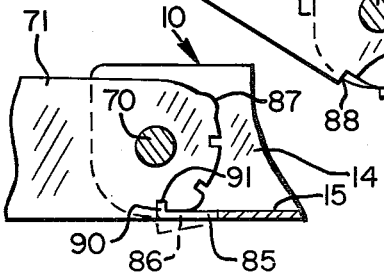
FIG. 6 is a view of a modification of FIG. 5 showing how the auxilary tools may be locked in an open position.

In an alternative construction shown in FIG. 6, each tool is positively locked in fully extended position or at one or more partially open positions by a flange 90 on the resilient spring tongue 86 which engages a radial notch 91 in the tool. Such a locking detent is releasable by partially opening one of the other tools on pivot pin 70 causing its cam surface 87 to retract the flange 90 out of notch 91 as indicated in broken lines in FIG. 6. In a similar manner the tools on pivot pin 75 may be mounted either as shown in FIG. 5 or FIG. 6.

The screwdriver bits 73 and 79 may be opened out as shown in FIG. 9 to provide handle extensions for increasing the leverage on either the cross-jaw pliers 22 or the parallel plier jaws 35. This provides the advantage of a long handled pair of pliers without increasing the length of tool when it is folded for carrying in the pocket. The invention is not limited to pocket tools however; the handles and tools may be made to any sized desired.

Figure 4:
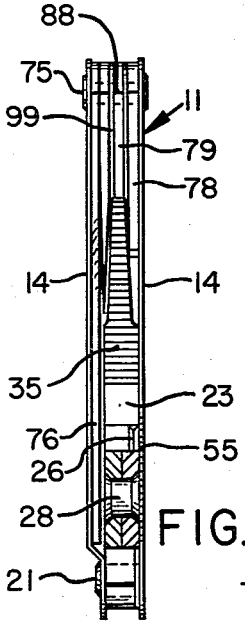
FIG. 4 is a view on the line 4—4 in FIG. 1.

The pliers are normally used with the tools on pivot pins 70 and 75 folded into the respective handles. In such position these tools provide additional cushioning surfaces between the side flanges 14 so that the squeezing force on the handles is not applied solely to the thin edges of side flanges 14. Thus, the auxiliary tools on the free ends of the handles cooperate and assist in the operations of the pliers in addition to the individual functions of the tools themselves. Further, as seen in FIGS. 3 and 4, while in storage some of the tools create a frictional grip on the sides of the parallel jaws 35, thus helping to hold the free ends 13 of the handles together in storage.

Pivot pins 20, 21, 70, and 75 can be rivets, screws and nuts, or other clamping devices. The ends of these pins exert axial clamping action in such a manner that frictional forces tend to keep all enclosed members from pivoting unless forces specifically intended to cause pivoting are applied. All members mounted on pins 20, 21, 70 and 75 are side to side, in frictional engagement with each other, allowing no lateral movement.

As long as tools fulfill the criteria described above, different tools may be substituted or added or existing tools may be changed or deleted and remain within the scope of this invention.

One side flange 14 of each handle is marked with a scale 95 to provide a ruler as illustrated in FIG. 13. The other side and the web could also be marked. To use the ruler, the cross-jaw plier jaws 22 are closed with the parallel jaws 35 in storage and the handles are aligned with adjacent ends abuting each other to provide a rule having a length equal to the combined length of both handles. In the pocket tool illustrated by way of example the length of the rule is seven and one-half inches.

The scope of this invention includes instruments with nonfolding or non-channel shaped handles that within the obvious limitations such conditions impose, allow the use of auxiliary jaws, locking mechanisms, and tools as described above.

What is claimed is:

1. A multiple instrument comprising a pair of cross jaw pliers having a pair of plier jaws pivotally connected together between nose ends and shank ends of the jaws, a first auxiliary jaw pivoted to said shank end of one of said cross jaws and engagable with said nose end of the other cross jaw, and a second auxiliary jaw pivoted to said shank end of the other cross jaw and engagable with said nose end of said one cross jaw, said auxiliary jaws being disengagable from said nose end of said cross jaws when using said cross jaws.

2. An instrument as defined in claim 1 including interengaging means on said cross jaws and auxiliary jaws for opening and closing said auxiliary jaws by the movements of said cross jaws.

3. An instrument as defined in claim 1 including interengaging means on said cross jaws and auxiliary jaws to prevent substantial lateral movements of said auxiliary jaws.

4. An instrument as defined in claim 1, said auxiliary jaws having pockets cavities in their nose ends to receive said nose ends of said cross jaws when said cross jaws are moved from open position to closed position.

5. An instrument as defined in claim 4 including cam surfaces in said cavities engaged by said nose ends of said cross jaws, said cam surfaces being shaped to impart parallel jaw movements to said auxiliary jaws when said cross jaws are closed.

6. An instrument as defined in claim 4 including transverse pins in said nose ends of said cross jaws engagable in slots in side walls of said pocket cavities to close and open said auxiliary jaws in parallel movements by the movements of said cross jaws.

7. An instrument as defined in claim 1 including a pair of handles connected to said shank ends of said cross jaws.

8. An instrument as defined in claim 7, said handles being pivotally connected to said shank ends of said cross jaws and foldable together in parallel side by side relation enclosing said cross jaws and auxiliary jaws within said handles.

9. An instrument as defined in claim 8, one of said auxilary jaws and one of said handles being connected to one of said cross jaws by a common pivot pin in said shank end of said one cross jaw and the other auxiliary jaw and other handle being connected to the other cross jaw by a common pivot pin in said shank end of said other cross jaw.

10. An instrument as defined in claim 9, said handles being of channel shape to receive said jaws in folded position with the open sides of the channels facing each other, said pivot pins being mounted in the side flanges of the channels at one end thereof.

11. An instrument as defined in claim 10, said channels having web portions with the ends of the webs engaging abutments on said shank ends of said cross jaws which are radial to said pivot pins to transmit closing forces to the jaws, and cam surfaces on said shank ends of said cross jaws resiliently engaged by said channel web portions to frictionally lock the handles to said cross jaws for opening the jaws.

12. An instrument as defined in claim 10, said channels having web portions, and cam surfaces on said shank ends of said cross jaws resiliently engaged by said channel web portions to frictionally hold said handles folded together in closed position for storage.

13. An instrument as defined in claim 10, said handle channels facing outward in the use of said pliers, and additional tools in said channels providing cushioning, force absorbing gripping surfaces between said side flanges in the use of the pliers.

14. An instrument as defined in claim 10 including additional tools in said channels pivotally mounted on pivot pins in said side flanges at the ends of the handles, said tools having notches radial to said pivot pins, flanged tongues on web portions of said channels engagable in said notches to lock said tools in selected positions, and cams on said tools operable on said channel web portions for disengaging said tongues from other of said tools on the same pivot pin.

15. An instrument as defined in claim 7 including locking means for holding either said cross jaws or said auxiliary jaws in clamping position.

16. An instrument as defined in claim 15, said locking means comprising a locking bar pivoted at one end on a pin in a shank end of one of said cross jaws, a pawl pivotally mounted on said locking bar, and teeth on the handle connected with the other cross jaw engagable by said pawl.

17. An instrument as defined in claim 16, said pawl pivoting to an over center locked position with respect to an imaginary line between the vicinity of the axes of said pivotal connection for said locking bar and said pawl, and stop means limiting the pivotal movement of said pawl in said over center position.

18. An instrument as defined in claim 16, said one end of said locking bar having a slotted opening receiving said pin in one end of said opening in locking position and receiving said pin in the opposite end of said opening for folding the locking bar into the handle connected with said one cross jaw.

19. An instrument as defined in claim 7 including at least one additional tool in each handle which is extendable from the end of the handle to serve as a handle extension for greater leverage to increase the force applied to the plier jaws.

20. In a pair of crossjaw pliers having a pair of jaw members pivotally connected together between nose ends and shank ends of the members, a locking bar pivotally connected to the shank end of one of said jaw members, multiple position abutment means on a handle connected to the other jaw member, a pawl pivotally connected with said locking bar to engage said abutment means for locking said jaw members in clamped position, said pawl pivoting to an over center locked position with respect to an imaginary line between the axes of said pivotal connections for said locking bar and said pawl, and stop means limiting the pivotal movement of said pawl in said over center position.

21. A pair of pliers as defined in claim 20, said stop means being on said locking bar.

22. A pair of pliers as defined in claim 20, said abutment means comprising a row of teeth on said handle.

23. A pair of pliers as defined in claim 20 including a pair of auxiliary jaws connected to said shank ends of said cross jaws and engagable with the nose ends of said cross jaws for operation by the cross jaws whereby said auxiliary jaws may be locked in clamped position by said pawl and locking bar.

* * * * *